US008403276B2

(12) United States Patent
Lewis et al.

(10) Patent No.: US 8,403,276 B2
(45) Date of Patent: Mar. 26, 2013

(54) VERTICAL SUPPORT SYSTEM FOR MUSICAL INSTRUMENTS

(75) Inventors: Thomas David Michael Lewis, Oakville (CA); Maurice Stephen Blimkie, Toronto (CA)

(73) Assignee: Thomas David Michael Lewis, Oakville, Ontario (CA)

( * ) Notice: Subject to any disclaimer, the term of this patent is extended or adjusted under 35 U.S.C. 154(b) by 112 days.

(21) Appl. No.: 12/805,547

(22) Filed: Aug. 5, 2010

(65) Prior Publication Data

US 2012/0032052 A1 Feb. 9, 2012

(51) Int. Cl.
*G10D 3/00* (2006.01)

(52) U.S. Cl. ..... 248/176.1; 248/519; 248/146; 84/280

(58) Field of Classification Search ..... 248/316.7, 248/121, 146, 154, 176.1, 519, 523, 524; 84/280, 327
See application file for complete search history.

(56) References Cited

U.S. PATENT DOCUMENTS

| | | | | |
|---|---|---|---|---|
| 1,774,096 | A * | 8/1930 | Hasterok et al. | 248/163.1 |
| 3,737,137 | A * | 6/1973 | Sheehan | 248/441.1 |
| 4,099,441 | A | 7/1978 | Landon | |
| 4,223,785 | A | 9/1980 | Jacques | |
| 4,377,268 | A * | 3/1983 | Wolford | 248/176.1 |
| 4,474,290 | A | 10/1984 | Demato | |
| 4,515,272 | A | 5/1985 | Newhouse | |
| 4,991,809 | A * | 2/1991 | Harkey | 248/229.12 |
| 5,024,328 | A | 6/1991 | Bontrager | |
| 5,029,796 | A | 7/1991 | Schoenig | |
| 5,149,901 | A | 9/1992 | Boor | |
| 5,207,327 | A | 5/1993 | Brondos | |
| 5,497,689 | A | 3/1996 | Hoshino | |
| 5,590,771 | A | 1/1997 | Cota | |
| 5,713,465 | A | 2/1998 | Choe | |
| 5,816,395 | A | 10/1998 | Dougherty | |
| 5,833,051 | A | 11/1998 | Tiefenbrun | |
| 5,876,813 | A | 3/1999 | Bambara et al. | |
| 6,540,182 | B1 * | 4/2003 | Wilfer | 248/121 |
| 6,576,822 | B1 * | 6/2003 | Grace | 84/327 |
| 6,727,415 | B1 | 4/2004 | Herring | |
| 7,351,896 | B2 * | 4/2008 | Clifford | 84/327 |
| 7,394,006 | B2 | 7/2008 | Bordignon | |
| 7,446,249 | B2 | 11/2008 | Driscoll | |
| 7,470,843 | B2 | 12/2008 | Hsieh | |
| 7,659,468 | B1 | 2/2010 | Gottlieb | |
| 2007/0163420 | A1 * | 7/2007 | Reiss et al. | 84/329 |

* cited by examiner

*Primary Examiner* — Terrell McKinnon
*Assistant Examiner* — Steven Marsh

(57) ABSTRACT

The present invention relates generally to a vertical instrument support system for musical instruments.

13 Claims, 12 Drawing Sheets

VERTICAL SUPPORT SYSTEM FOR MUSICAL INSTRUMENTS

FIELD OF INVENTION

The present invention relates generally to a vertical instrument support system for musical instruments. More particularly, the invention relates to a musical instrument support that cooperates with the instrument's structure to provide a support for safely and conveniently resting an instrument against a generally vertical surface.

BACKGROUND OF INVENTION

During rehearsals and performances, musicians find it necessary to periodically set their instruments aside, in order to play a different instrument, to take a rest break, or to complete some other activity. It is desirable to rest an instrument in a place that is protected from possible damage to the instrument, yet conveniently accessible when needed. Musicians tend to be unwilling to place musical instruments on the ground and against a wall because they are afraid that the instrument may fall and be damaged. Therefore, musical instruments that are capable of being rested generally upright or vertical have been traditionally held by an instrument holder, support or stand.

Freestanding instrument stands are available in a variety of designs and are generally designed to completely or partially support the weight of and balance an instrument. Traditional instrument supports or stands, however, have several disadvantages including that they may be unstable, awkward to transport and set up, and take up too much space. Typically, the stands are tailored to receive a particular instrument and cannot be used with multiple instruments. Made from heavy steel tubing or hardened plastics, instrument stands generally require some assembly in order to use and once assembled take up significant space with the instrument in locations where space is limited (e.g. on stage). With space being at a premium, it is inconvenient to place a freestanding instrument stand among the other items of equipment on stage or in a studio. While freestanding instrument stands are designed to be as compact as possible, some floor space is occupied by the supports for the stand. It is desirable to have a relatively large base for the supporting members of an instrument stand to prevent the stand from toppling over, in the event of accidental contact with moving persons or equipment. Modern music performances involve significant amounts of activity on stage and instrument stands are susceptible to toppling. Certain instruments, such as string instruments, present particular difficulties. The relatively long neck and rounded body make string instruments less balanced in a resting position and susceptible to being toppled over. As such, string instruments tend to be unsuitable for simply leaning against an object, such as an amplifier. It is common for musicians to rehearse, record, and perform in an area crowded with equipment. In addition to lighting, microphone stands and wiring, larger equipment such as amplifiers and combination amplifiers are frequently present in the area where musicians are working. Therefore, such prior art stands have a tendency to become tripping hazards or snag points, leaving a sense of insecurity for the instrument and the musician.

A number of patents are directed to instrument stands, including U.S. Pat. Nos. 4,099,441; 4,223,785; 4,474,290; 4,515,272; 5,024,328; 5,029,796; 5,149,901; 5,207,327; 5,497,689; 5,590,771; 5,713,465; 5,816,395; 5,833,051; 5,876,813; 7,659,468; 6,727,415; 7,470,843; 7,446,249; and 7,394,006.

U.S. Pat. No. 7,659,468 to Gottlieb is directed to a guitar stand system including a bracket, a strap, and one or more studs. The bracket is provided with an upper portion having a horizontally projecting brace and a lower portion having a pair of downwardly projecting legs defining a slot therebetween. A pair of spaced apart hitches is provided on the upper portion of the bracket. The studs may be mounted on a stable object or structure and the bracket may be slidably engaged on the studs. A guitar may be leaned adjacent to the bracket. The strap, which is provided with an "O" ring at each end, may be drawn across the guitar neck and the "O" rings may be engaged on the hitches to confine the guitar securely on the stand.

U.S. Pat. No. 6,727,415 to Herring is directed to a rest for guitar-like instruments which is internally configured to receive the bottom of a guitar-like instrument and to allow the instrument to lean against another object. Preferably, a groove is provided in the bottom of the rest to allow the rest to fit over the handle of an amplifier. Also, the cavity is preferably shaped such that the back of the top of the guitar-like instrument leans on a wall or other supporting structure.

U.S. Pat. No. 7,470,843 to Hsieh is directed to a foldable guitar holder which has a stationary shaft, a central shaft assembly and two symmetrical brackets. The stationary shaft has an upper end and a lower end. The central shaft has a central shaft and two assistant shafts. The central shaft has a standing portion and a longitudinal hole receiving the lower end of the stationary shaft. The assistant shafts connect pivotally to the central shaft and have two standing ends. The brackets have two supporting shafts and two holding brackets. Each supporting shaft connects pivotally to the lower end of the stationary shaft and one of the assistant shafts and has a standing part. Each holding bracket connects pivotally to the upper end of the stationary bracket. The standing portion, standing ends and standing parts allow the guitar bracket to stand on the ground steadily.

U.S. Pat. No. 7,446,249 to Driscoll is directed to a support for a musical instrument manufactured from a firm yet pliable material which is slid under the supporting handle of an amplification device or slid between two stacked amplification devices by a finger hole at one end. The fingerboard or neck of a musical instrument, when stood upright on the floor, can be inserted into a socket on the other end of the device providing support when the instrument is not being played and providing a convenient and safe means of storage when the instrument is not in use. Two gear-shaped ends assist in sliding the device under the handle of the amplification device and the two slots by the socket hold guitar plectrums.

U.S. Pat. No. 7,394,006 to Bordignon is directed to a bearing element for stringed musical instruments comprising a mainly vertically arranged frame, placed on a bearing surface provided with support means which defines a housing able to receive the body of the instrument. Each of the support means comprises a couple of mutually opposed jaws, slidingly coupled to the support means and joined together through regulation means able to modify in a continuous way the distance between the jaws, which comprise a shaped body defining a concave surface bounding on one side said housing.

There are a number of deficiencies with the prior art devices. As such, there is a need for a vertical instrument support system that addresses these deficiencies. In addition, there is a need for a vertical instrument support system that can be stable, easy to use, easily and conveniently releasable, occupies minimal floor space, adaptable to a variety of instruments and holds instruments without damage thereto.

SUMMARY OF THE INVENTION

An aspect of the present invention is directed to a instrument support system for supporting an instrument in a generally vertical position, the system comprising: a horizontal support comprising a first surface for engaging a first portion of the instrument, a second surface for engaging a generally horizontal surface and a groove extending from the first surface towards the second surface; a vertical support comprising a first surface for engaging a second portion of the instrument, a second surface for engaging a generally vertical surface; and a cover adapted to receive a third portion of the instrument.

A further aspect of the present invention is directed to a support system wherein the groove is adapted to receive the first portion of the instrument so that the first portion of the instrument does not engage the generally horizontal surface.

Yet a further aspect of the present invention is directed to a support system wherein the groove is a bore extending through the first surface of the horizontal support.

Yet a further aspect of the present invention is directed to a support system wherein the instrument is a string instrument or a wind instrument.

Yet a further aspect of the present invention is directed to a support system wherein the vertical support is annular.

Yet a further aspect of the present invention is directed to a support system wherein the horizontal support is annular.

Yet a further aspect of the present invention is directed to a support system wherein the first portion of the instrument is the body of the instrument.

Yet a further aspect of the present invention is directed to a support system wherein the second portion of the instrument is the neck of the instrument.

Yet a further aspect of the present invention is directed to a support system wherein the string instrument is selected from the group consisting of guitar, violin, viola, cello, double bass, banjo, mandolin, and ukulele, guitarro and sitar Yet a further aspect of the present invention is directed to a support system wherein the wind instrument is selected from the group consisting of saxophone, bassoon, bagpipes, EWI™ Electronic Wind instrument, cornet, pan flute, Andean wind instrument or trombone.

Another aspect of the present invention is directed to an instrument support system for supporting an instrument in an upright position, the system comprising: a first annular support comprising a first surface for engaging a first portion of the instrument, a second surface for engaging a generally horizontal surface and a bore extending from the first surface through to the second surface; a second annular support comprising a first surface for engaging the first portion of the instrument and a second surface for engaging the first surface of the first annular support.

A further aspect of the present invention is directed to a support system wherein the groove is adapted to receive the first portion of the instrument so that the first portion of the instrument does not engage the generally horizontal surface.

Yet a further aspect of the present invention is directed to a support system wherein the groove is a bore extending through the first surface of the horizontal support.

Yet a further aspect of the present invention is directed to a support system wherein the vertical support is annular.

Yet a further aspect of the present invention is directed to a support system wherein the horizontal support is annular.

Yet a further aspect of the present invention is directed to a support system wherein the first portion of the instrument is the body of the instrument.

Yet a further aspect of the present invention is directed to a support system wherein the second portion of the instrument is the neck of the instrument.

Yet a further aspect of the present invention is directed to a support system wherein the second surface of the annular support is comprised of a non-slip material with a co-efficient of friction sufficient to arrest any movement by support once the instrument is inserted in support.

Yet a further aspect of the present invention is directed to an instrument support for supporting an instrument in an upright position, the support comprising a first surface for engaging a first portion of the instrument, a second surface for engaging a generally horizontal surface and a groove extending from the first surface towards the second surface.

BRIEF DESCRIPTION OF THE DRAWINGS

The embodiments of the present invention shall be more clearly understood with reference to the following detailed description of the embodiments of the invention taken in conjunction with the accompanying drawings, in which.

DETAILED DESCRIPTION OF EMBODIMENTS OF THE INVENTION

Figure 1:
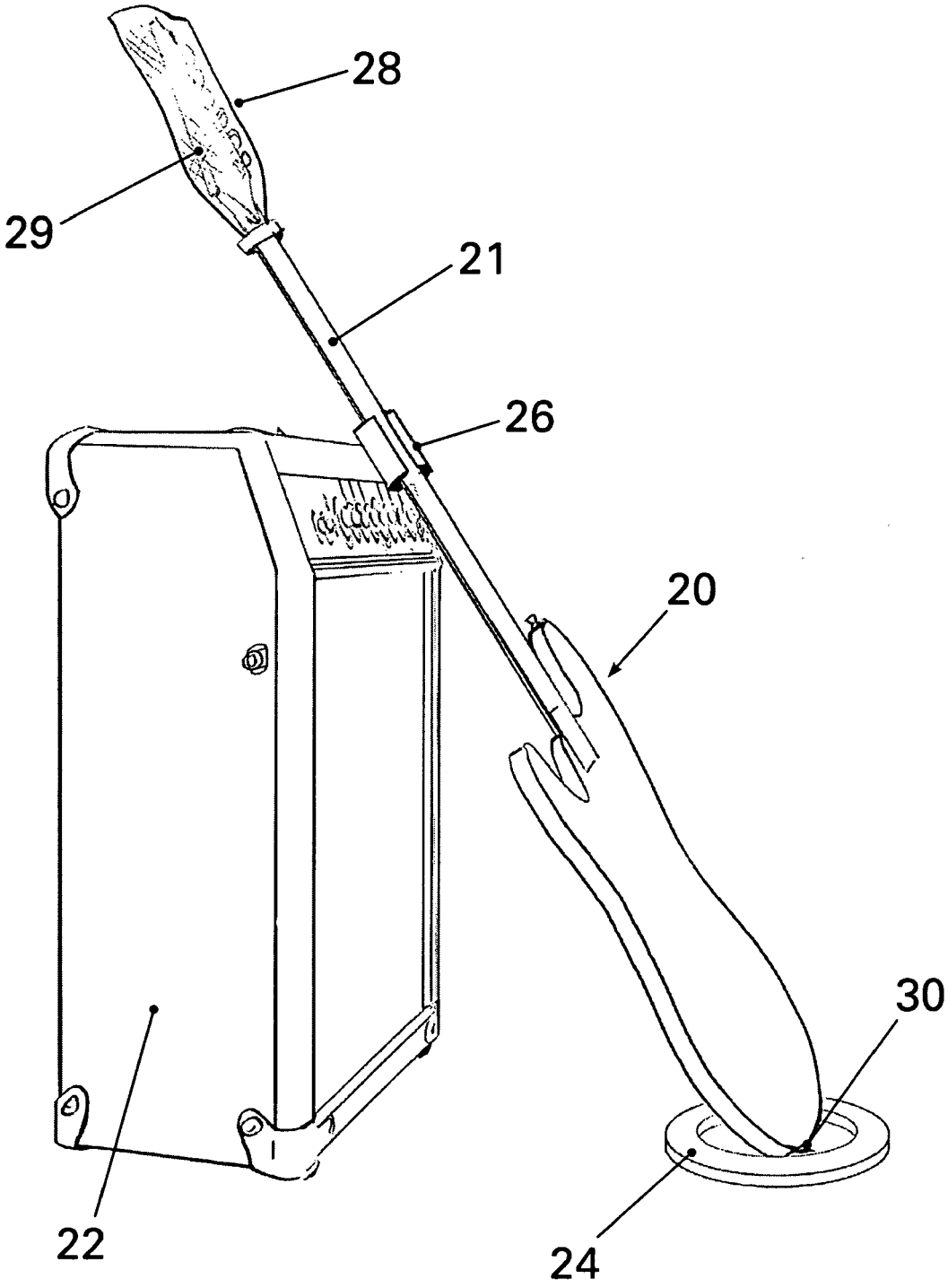
FIG. 1 is a front left perspective view of a musical instrument provided with a vertical object support and anti-slip system according to an embodiment of the present invention.

The description which follows, and the embodiments described therein are provided by way of illustration of an example, or examples of particular embodiments of principles and aspects of the present invention. These examples are provided for the purposes of explanation and not of limitation, of those principles of the invention. In the description that follows, like parts are marked throughout the specification and the drawings with the same respective reference numerals.

In the description and drawings herein, and unless noted otherwise, the terms "top", "bottom", "front" and "back" are references to a co-ordinate system in which the term "top" will be understood to refer to an area proximate to the headstock of a string instrument or the neck of a wind instrument. The term "bottom" will be understood to refer to an area proximate the body of the instrument. The term "front" will be understood to refer to the surfaces of the instrument in which the strings or keys are placed for use by the musician. It will be understood that the term "back" will refer to the surfaces provided without the strings or keys and opposing the front surface of the instrument.

In the description and drawings herein, and unless noted otherwise, the term "vertical" will be understood to orientations greater than approximately 45° to the plane of the horizon or base line provided by the ground or an elevated platform such as, but not limited to, a stage.

Musical instruments are generally within one of the four main divisions of instruments in the original Hornbostel-Sachs scheme of musical instrument classification; chordophones are musical instruments that makes sound by way of a vibrating string or strings stretched between two points; idiophones are musical instruments that creates sound primarily by way of the instrument vibrating itself, without the use of strings or membranes; membranophone are musical instruments that produces sound primarily by way of a vibrating stretched membrane; electrophones are musical instruments that produces sound primarily by electrical means; and aerophones are musical instruments that produces sound primarily by causing a body of air to vibrate.

Instruments that can be used with embodiments of the present invention include instruments that require a stand or are typically leaned against supporting surfaces (e.g. walls, amps, etc.) since the shapes thereof do not allow them to be stably rested in an upright or vertical orientation without such support. It will be understood that a variety of instruments or replicas thereof can be used with the embodiments of the present invention. In a preferred embodiment, aerophones (wind instruments) and chordophones (string instruments) may be used in association therewith.

It will be understood by a person skilled in the relevant art that "wind instruments" shall refer to a musical instrument that contains some type of resonator, such as a tube, in which a column of air is set into vibration by the player blowing into or over a mouthpiece proximate the neck and set at the end of the resonator. The pitch of the vibration is determined by the length of the tube and by manual modifications of the effective length of the vibrating column of air. In the case of some wind instruments, sound is produced by blowing through a reed; others require buzzing into a metal mouthpiece. Examples of wind instruments include the saxophone, bassoon, bagpipes, EWI™ Electronic Wind instrument, cornet, pan flute, Andean wind instrument or trombone. It will be understood by a person skilled in the relevant art that any member of the broad group of wind instruments would be suitable for use with the present invention.

It will be understood by a person skilled in the relevant art that string instruments shall refer to a set of musical instruments that produce sound by means of vibrating strings. Examples of string instruments include the guitar, violin, viola, cello, double bass, banjo, mandolin, and ukulele, guitarro and sitar. It will be understood by a person skilled in the relevant art that any member of the broad group of string instruments would be suitable for use with the present invention.

A person skilled in the relevant art will understand that although there are many different types of string instruments, such as including but not limited to guitars, this group of instruments have many common design features. Provided at the top portion of the instrument is the "headstock". Provided within the headstock are one or more "tuners" or "tuning pegs", which the musician will use to adjust the tension of each of the strings of the instrument. The headstock is generally attached to a slimmer neck portion or "neck" of the instrument. At the point at which the headstock meets the neck of the instrument, there is provided the "nut", which is typically a small piece of material, such as, for example, plastic, bone, or brass, copper, aluminum, ebony, ivory, nickel, metal, graphite, titanium, corian, TUSQ™ in which small indentations or grooves may be provided to guide the strings of the instrument to the tuners and maintain the strings in a particular location along the neck and headstock. The neck of the instrument is that portion of the instrument that the musician places one set of fingers to manipulate the strings so as to create different notes. The neck of the guitar adjoins the "body" of the instrument. The body of the instrument may vary greatly between instruments. Most acoustic and classical guitars, for example, have a hollowed out body, and a "sound hole", designed to project the sound of the guitar. Most electric guitars have a solid body, and thus may not have a sound hole. Electric guitars may instead have "pick-ups" where the sound hole would be located. These "pick-ups" tend to be essentially small microphones, which allow the capture the sound of the strings, allowing them to be amplified. The strings of the instrument generally run from the tuners, over the nut, down the neck, over the body, over the sound hole (or pick-ups), and are anchored at a piece of hardware attached to the body of the guitar, called a "bridge". For older instruments, there may also be provided on a bottom portion of the instrument body a strap body or peg on which a support strap will be attached to the body of the instrument. When attached to both the top (e.g. headstock) and bottom (e.g. strap peg) of the instrument, the support strap allows a musician to play the instrument, such as, for example, a guitar, without having to support the instrument with his or her hands. Such a set-up may not be employed in more recent instruments; guitar strap pegs may be attached to the bottom and the upper portion of the body or "horn" of an electric guitar or upper body of an acoustic guitar.

FIG. 1 shows a preferred embodiment of the present invention. As shown in FIG. 1, there is provided musical instrument 20. Musical instrument 20, as shown in FIG. 1, is represented as a guitar. It will be understood by a person skilled in the relevant art that any string instrument may be used. In a preferred embodiment, instrument 20 is an electric guitar and there is provided amplifier 22 against which instrument 20 is leaning in a resting orientation which is generally upright or vertical. It will be understood that instrument 20 can be leaned against any generally vertical surface such as, for example, a wall or amplifier. It will be seen from FIG. 1 that instrument 20 is leaning with the front of the instrument oriented towards the amplifier. In this preferred configuration, the strings are oriented towards amplifier 22 while the back of instrument 20 is oriented away from amplifier 22. With the back of instrument oriented outwards as provided in FIG. 1, the strings of the instrument are protected in the resting position or orientation from people or objects brushing against them. In doing so, instrument 20 and the strings thereof are not harmed. Not only are the strings protected, but so are the knobs and switches or front mounted output jacks provided on the front of the guitar. As an alternative embodiment, a musician may place a guitar facing outwards (back of body facing the amp). This position would be used if the musician wishes to display the front of the guitar (e.g. display a design on the guitar).

As shown in FIG. 1, there is provided a vertical instrument support system in accordance with a preferred aspect of the present invention. There is provided support 24, collar 26 and cap 28. In a preferred embodiment, support 24 is generally horizontal and, in a further preferred embodiment, can be generally ring-like or annular in shape. In other embodiments, support 24 can be a plurality of other shapes, provided that the support is adapted to support instruments such that the bottom of the instrument body and any protruding strap pegs or other attachments do not touch the surface on which support 24 rests. Support 24 is provided with a groove or, as provided in FIG. 1 an opening 30 into which the lower portion of the body can placed. It will be understood that the opening need not extend through the support. Instead, the groove may extend towards the horizontal surface sufficiently to support a portion of the body of the instrument. The thickness and weight support efficiency of support 24 causes the instrument body to be supported to a height above the underlying surface sufficient enough to prevent direct surface to body contact. Support 24 can be made of any non-slip material with a co-efficient of friction sufficient to arrest any movement by support 24 once the instrument is inserted in support 24.

Figure 6:
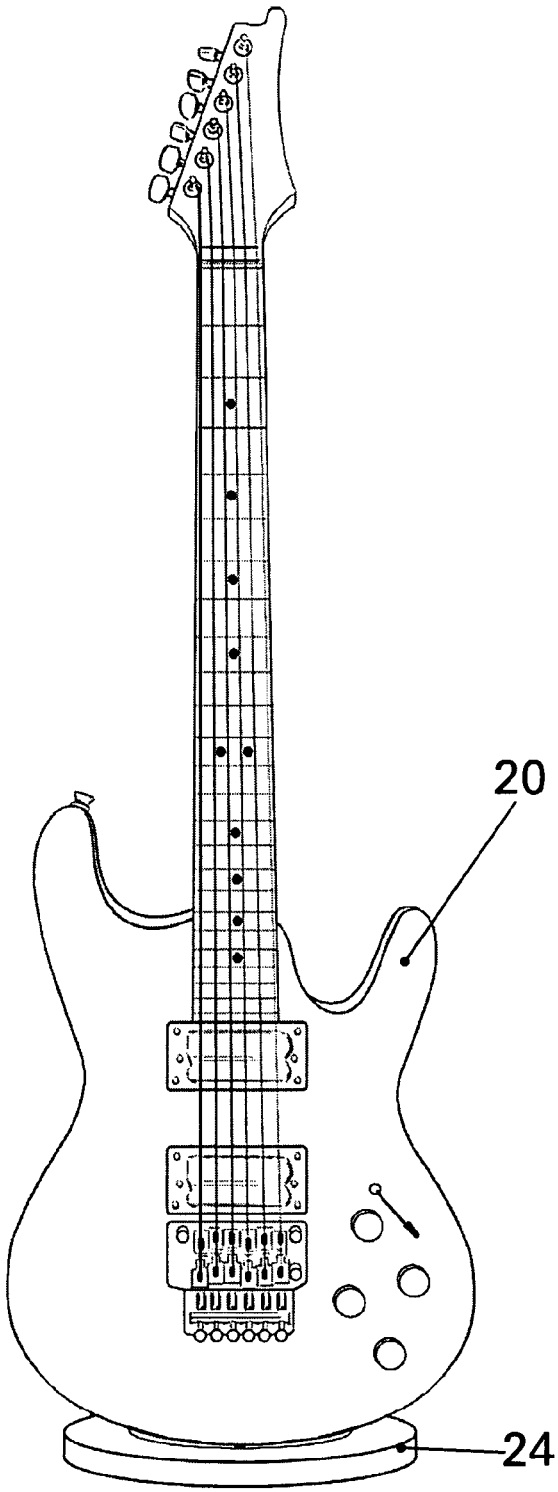
FIG. 6 a front and rear view of an embodiment of the present invention.
Figure 7:
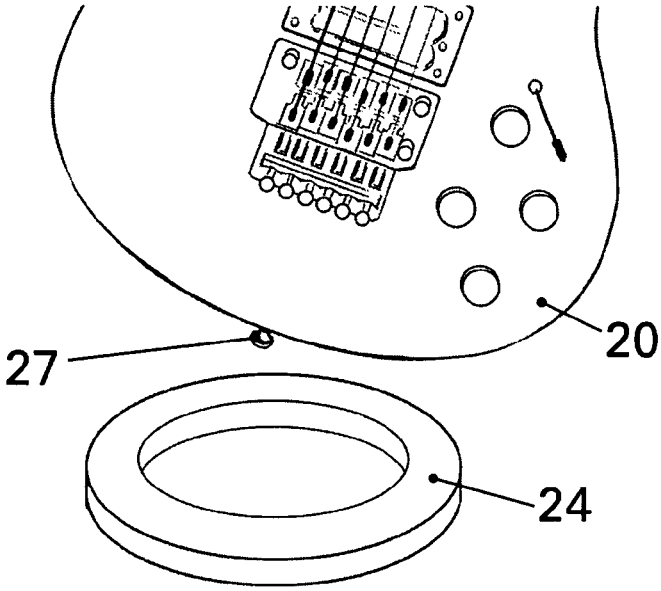
FIG. 7 & FIG. 8 are exploded views of aspects of embodiment of the present invention.
Figure 8:
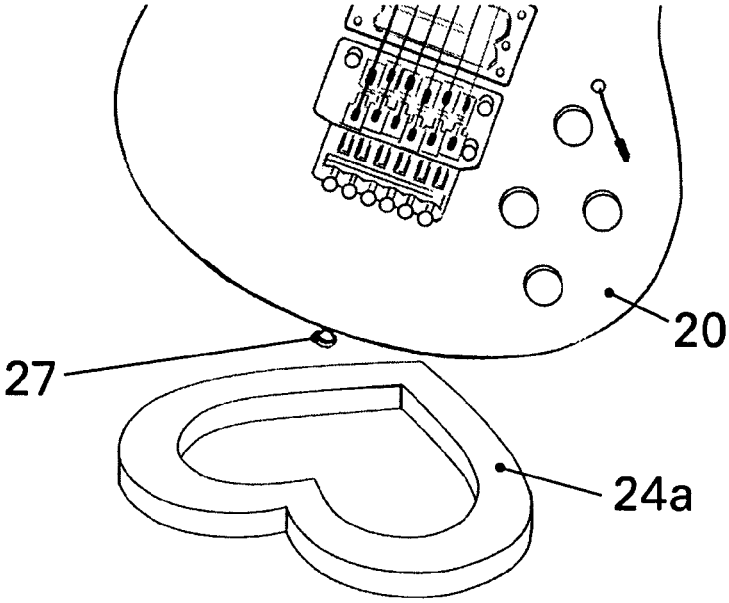

As shown in FIG. 6, opening 30 in support 24 allows for instrument strap peg 27 or other protrusion extending from instrument body 20 to rest without contact with the horizontal surface upon which support 24 rests. The edge of support 24 arrests the vertical movement of instrument body 20 downward so as to prevent direct contact of the strap peg or other protrusion with the underlying resting surface. Without this embodiment, there could be contact damage to the peg or general instability of the instrument. Many musicians or players use a "strap lock" system. This locking nut/washer system plugs directly into a user installed aftermarket strap peg. These systems involve a button release mechanism that could be protected from contact with the horizontal surface.

Figure 4:
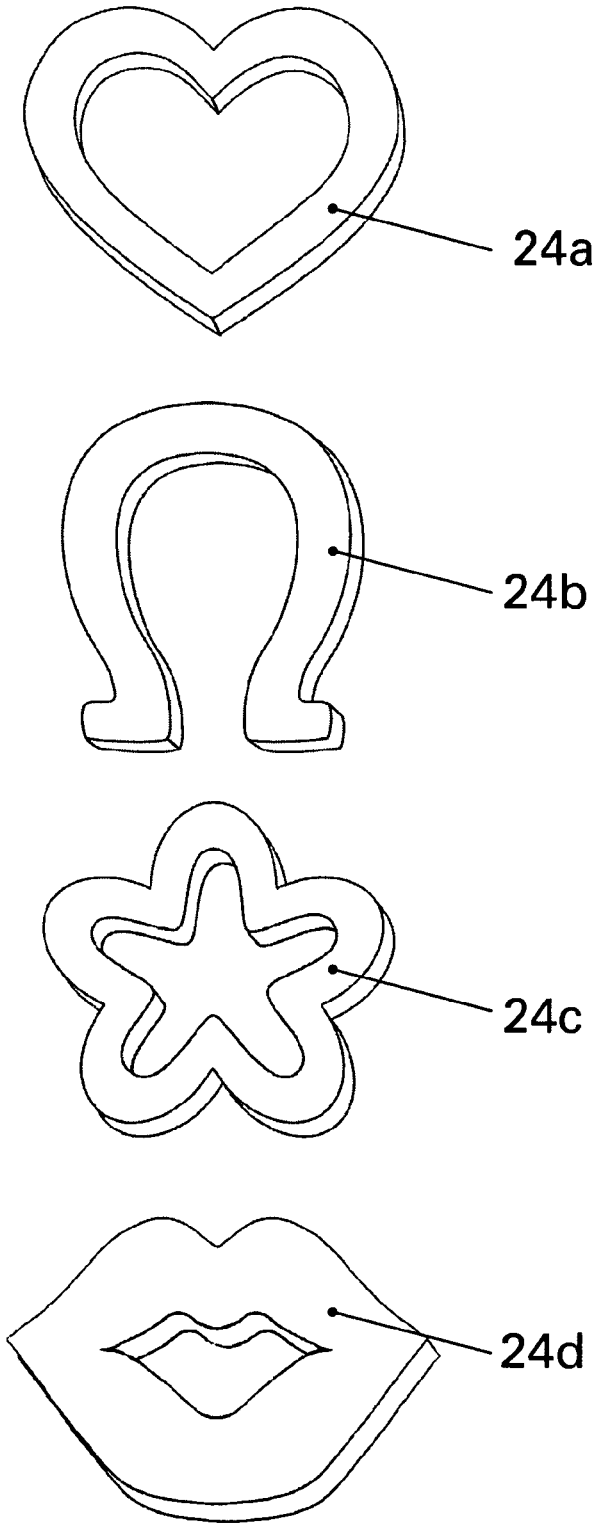
FIG. 4 is a top perspective view of embodiments of the present invention shown in FIG. 1.

In a preferred embodiment, support 24 can conform to the shape and contour of the instrument. In yet another embodiment, the shape of support 24 can vary to accommodate a number of different shapes based on artists' personal selection. While having the same functional characteristics, support shapes can be based on aesthetic considerations, such as, for example, circle, oval, rectangle, diamond, square, ring, trapezoid, pentangle, peace sign, π, number sign, Stonehenge, coliseum, hand peace sign, Vulcan hand sign 'live long and prosper', heart, flowers, plants, branded logos, pretzel, lightning bolt, record disc insert, shapes of human and animal body parts or other objects (see 24*a* to 24*d* in FIG. 4). It will also be understood that the shape and size of support 24 can be varied to accommodate a number of differently sized instruments and aesthetic features.

In a preferred embodiment, support 24 can be made from viscous-elastic polyurethane foam, also known as memory foam, Santoprene, foam rubber, synthetic rubber, natural rubber, leather, silicone, inert neoprene, vinyl, plastic, cloth and cotton. Preferred examples of non-slip or non-skid material that may be used with the embodiments of the present invention, include, but not limited to, viscous-elastic polyurethane foam, also know as memory foam, Santoprene, foam rubber, synthetic rubber, natural rubber, leather, silicone, inert neoprene, vinyl, plastic, cloth and cotton.

Figure 2:
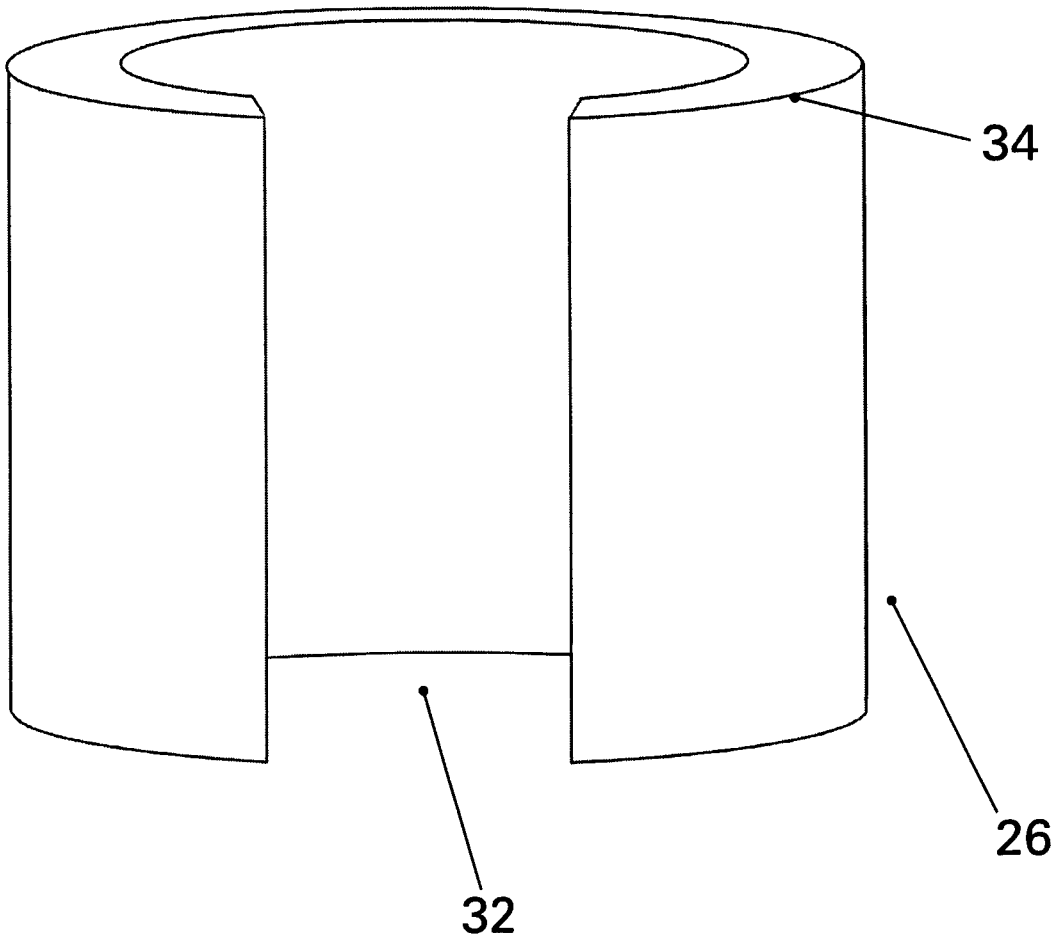
FIG. 2 is a front left perspective view of an aspect of the vertical object support according to an embodiment of the present invention.
Figure 3A:
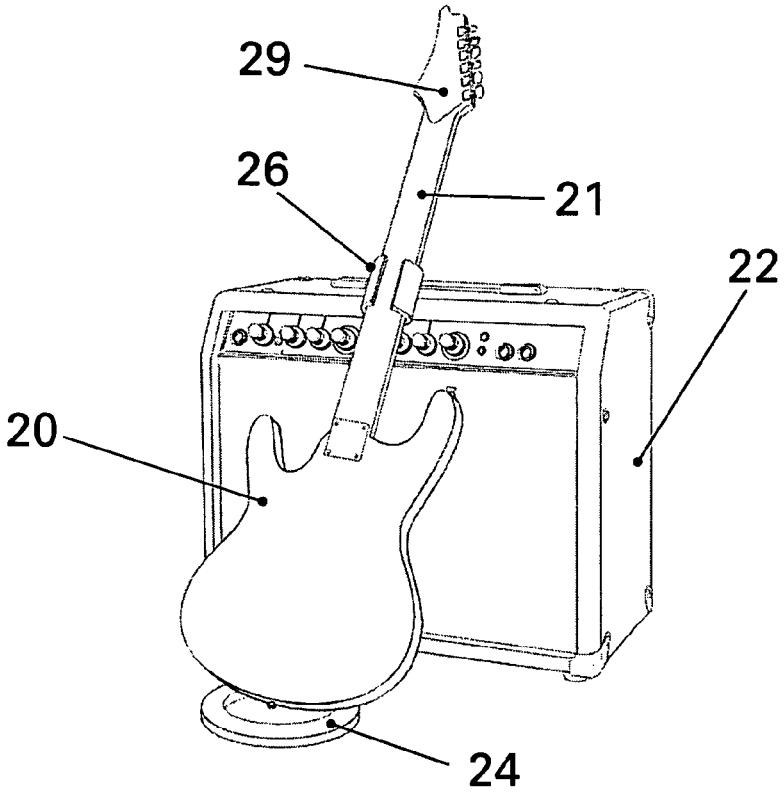
FIGS. 3A & 3B are front views of an aspect of the vertical support according to the embodiment shown in FIG. 1.
Figure 3B:
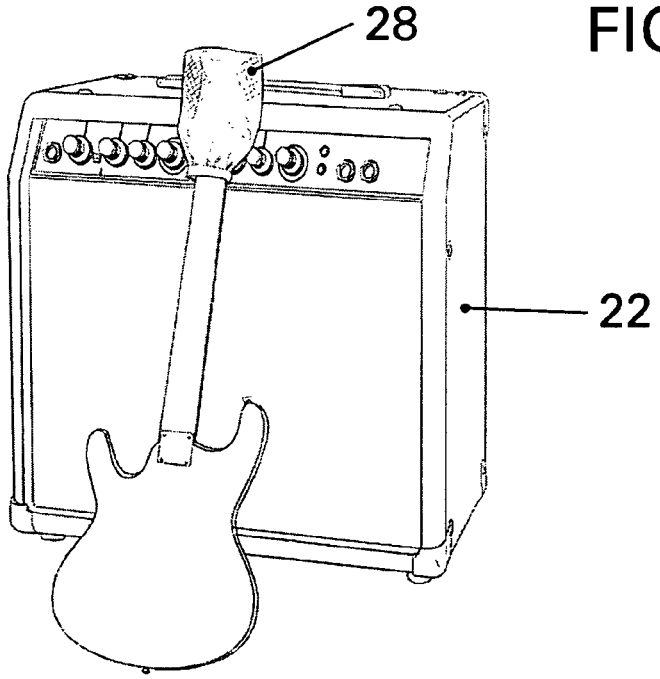
Figure 5:
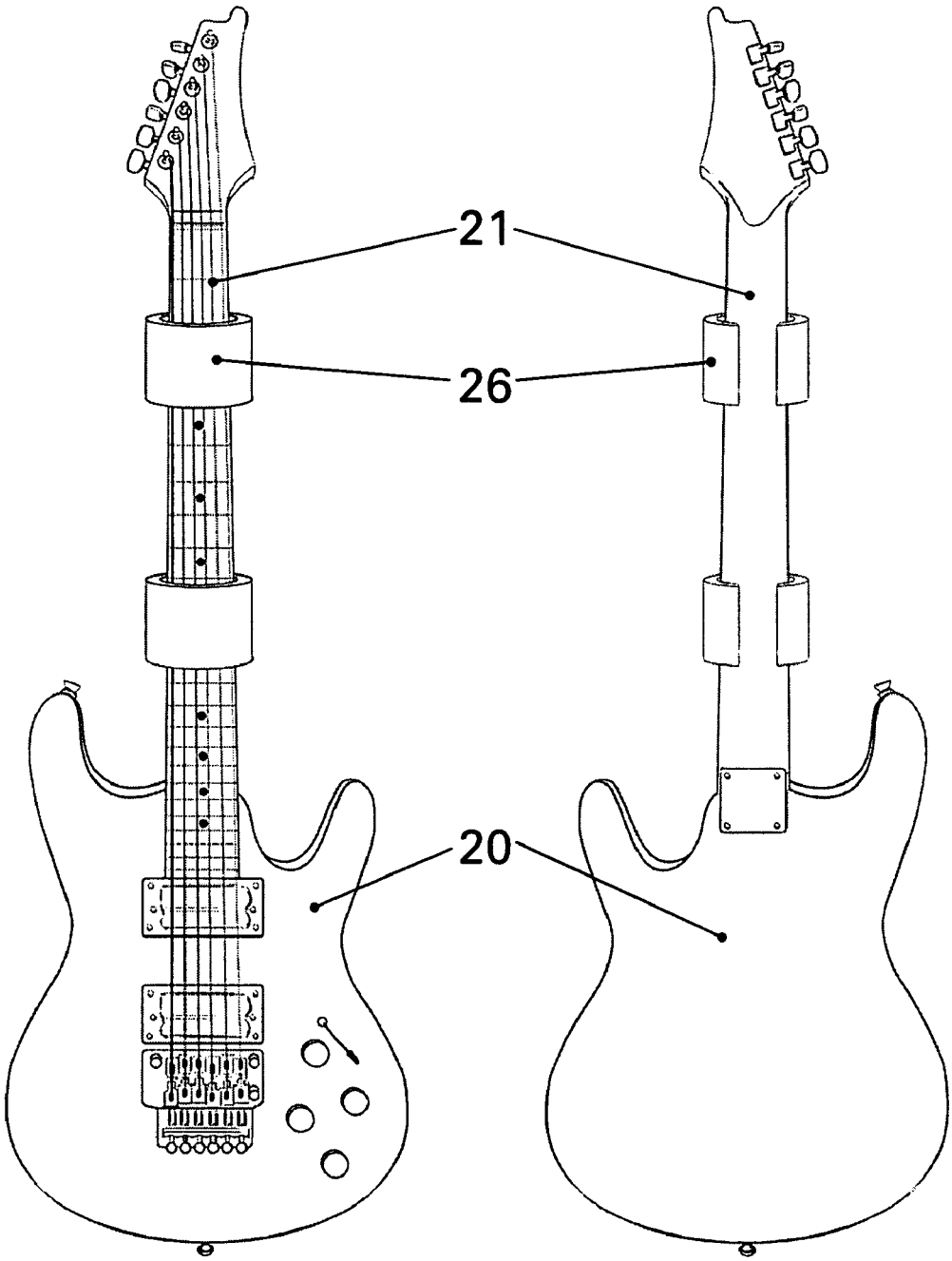
FIG. 5 is a front and rear view of an embodiment of the present invention.

As shown in FIG. 2, there is provided an exploded view of collar 26. Collar 26 may be provided proximate to the junction between the neck and the body of the instrument. The specific location will depend on the degree of verticality of the instrument and upon where the instrument is to be placed adjacent, such as an amplifier (as shown in FIGS. 1 and 3) or next to a wall (not shown). Collar 26 has an opening 32 through which a user can insert the neck of the instrument. As seen in FIG. 1, collar 26 may be placed on neck 21 or other body, its positioning moveable and removable through opening 32. As shown in FIG. 5, once collar 26 has been inserted on to instrument 20, it may be moved vertically along neck 21. It will be understood that neck 21 will be inserted through collar opening 32 such that the body 34 of collar 26 may encompass neck 21. In a preferred embodiment, collar opening 32 will be adapted to rest across the front of neck 21 so as not to interfere with the strings of the musical instrument in the vertical resting position. In a further preferred embodiment, collar body 34 will be adapted to allow the instrument to rest in the vertical position without the strings being in contact with the resting surface. It will be understood, however, that the collar body 34 may also be used to provide protection for the strings (see FIG. 3(*a*)). The collar would prevent the vertical surface and the string or fret board to have direct contact. This can help with electrical ground contact noise (from the conductivity of metal strings to metal chassis of some amplifiers). Stretched strings may also go out of tune as a result of string stretching due to contact with vertical surface when either the instrument or the amp may be bumped or moved. Further, there is the potential for string damage from a burred or nicked amplifier chassis or trim of amplifier/rack case would be avoided with use of the collar. It will also be understood that the shape and size of collar 24 can be varied to accommodate a number of differently sized instruments and aesthetic features.

In a preferred embodiment, collar 26 can be made from foam, rubber, plastic, silicone or any other soft material, it can be designed as a bladder which can be inflated with air, filled with gel/liquid or contain sand, beans or other granular substance. In a preferred embodiment, collar 26 can be made Santoprene, foam rubber, synthetic rubber, natural rubber, leather, silicone, inert neoprene, vinyl, plastic, cloth and cotton.

In a preferred embodiment, the support 24 may be made out of memory foam so as to conform to uneven surfaces such as grass or uneven ground. Typically these kinds of surfaces are encountered when a musician plays an outdoor event, such as, but not limited too, weddings, barbeques, etc.

Figure 13A:
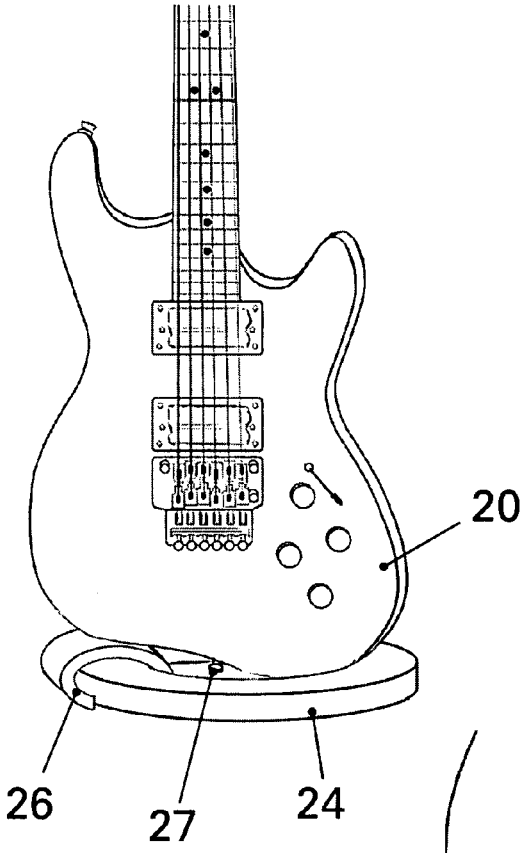
FIG. 13 is a front view of an embodiment of the present invention.
Figure 13B:
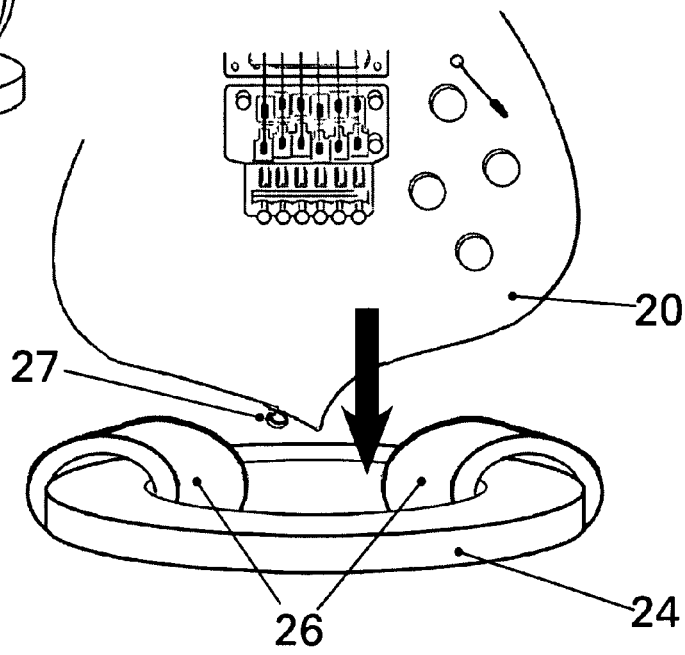

In a further embodiment, collar 26 may also be provided with a wire "spine" or insert so as to grip the guitar strings tight enough to silence or mute them. This would be an added anti-feedback, anti-string vibration quality-beneficial in the case of guitar amps being mistakenly left on while the guitar leans against or an acoustic guitar, without electronic volume control, sympathetically vibrating to resonating frequencies coming from stage noise, monitor noise etc. As shown in FIG. 13, collar 26 can be comprised of a number of different designs such as hands. Other designs may include, but are not limited too, bullet shape, snake/animal/human mouth shape, spiked (soft foam) punk rock/heavy metal wrist band, Rock n Roll belt aesthetic, Logo on collar, Glow-in-the-dark graphic, Reflective tape graphic or U-shaped bill fold. It will be understood, however, by a person skilled in the relevant art that any aesthetic design can be incorporated provided it encompasses the functionality described herein.

Figure 14:
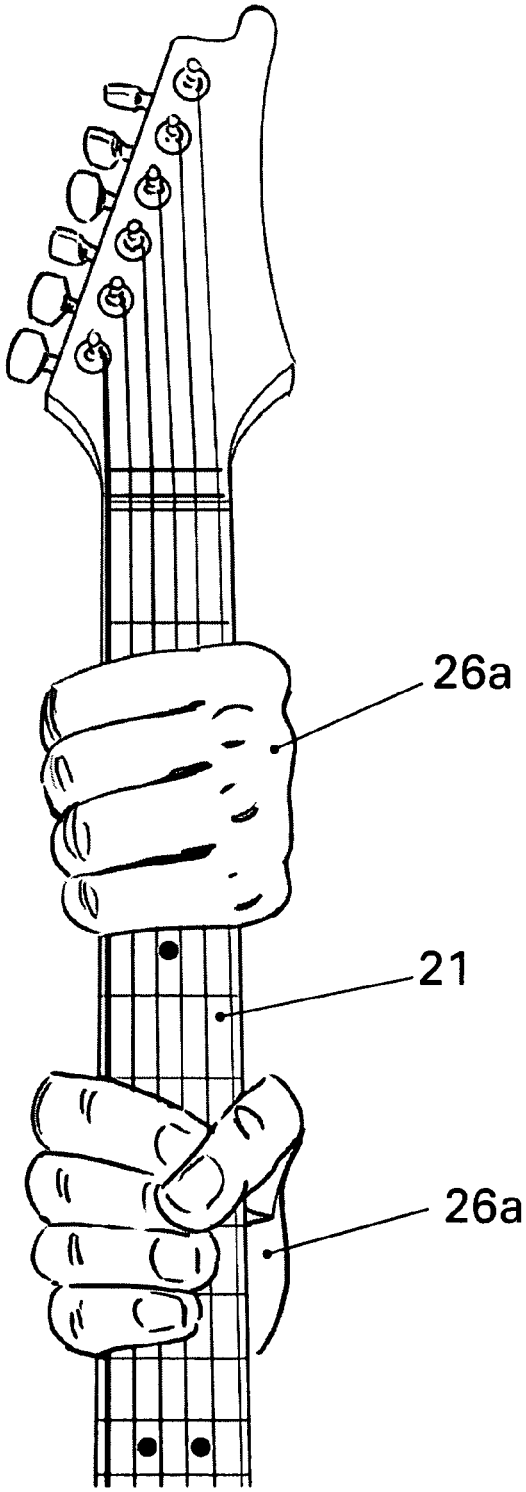
FIG. 14 is a front view of an embodiment of the present invention.
Figure 15:
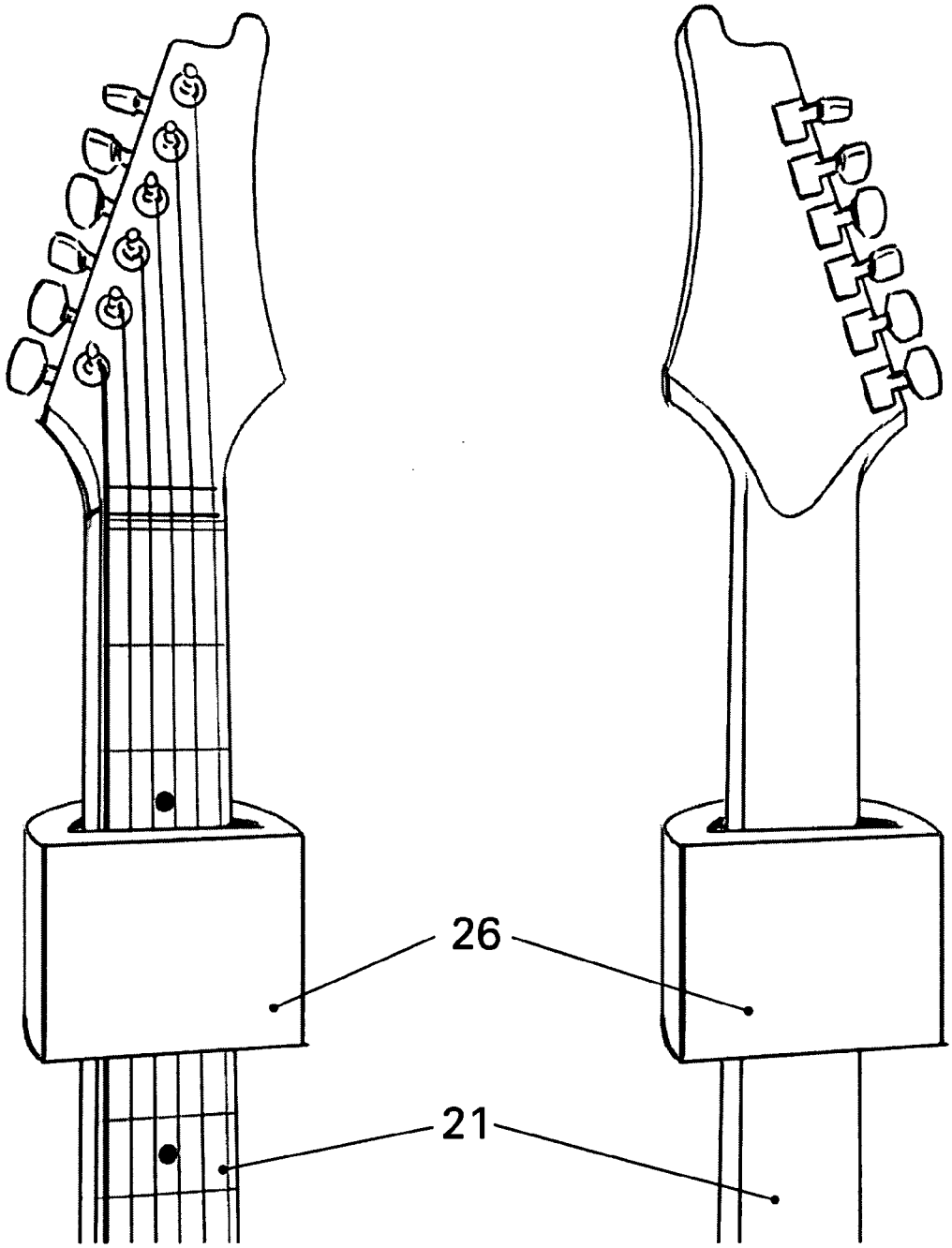
FIG. 15 is a front view of an embodiment of the present invention.

As shown in FIG. 14(*a*), there is provided yet a further embodiment of the present invention. Collar 26*a* is generally hemispherical. The flat side and be leaned against the vertical surface or away from the vertical surface in accordance with the embodiments described above.

Figure 9:
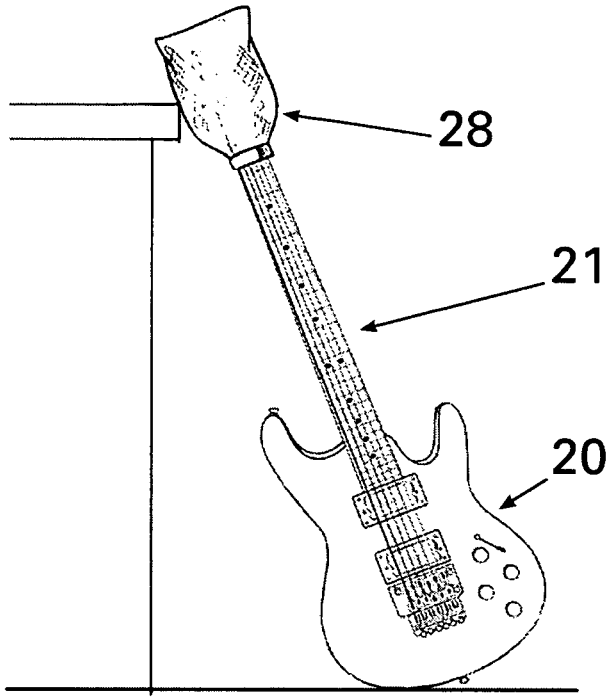
FIG. 9 is a front view of an embodiment of the present invention.
Figure 10:
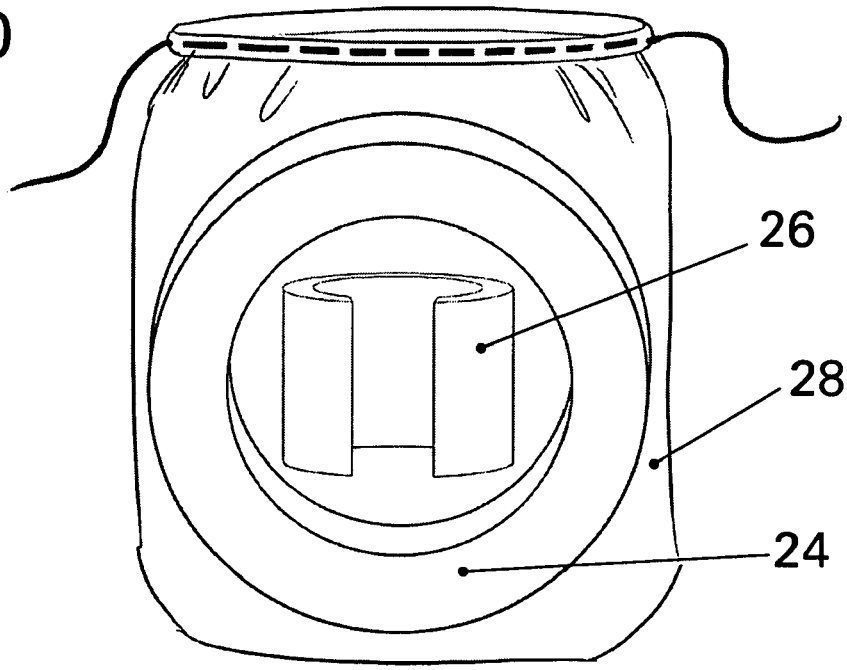
FIG. 10 is a front view of aspects of embodiments of the present invention.
Figure 11A:
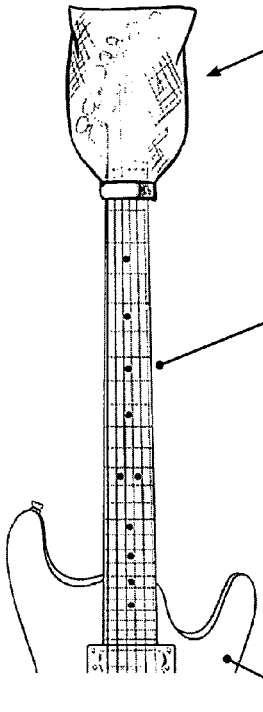
FIGS. 11A & 11B are front views of an embodiment of the vertical support according to the embodiment shown in FIG. 10.
Figure 11B:
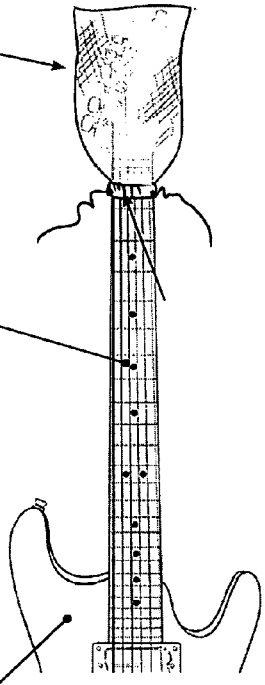

As shown in FIG. 9, there is shown cap 28. Cap 28 is adapted to be inserted over headstock 29. In a preferred embodiment, cap or sock 28 may be of sufficient size to contain all components of the instrument vertical object support system when not in use. As shown in FIG. 9, there is provided support 24 and collar 26 disposed within cap 28. This provides a convenient manner in which to carry the entire system. Once emptied of the contents, cap 28 can be placed over headstock 29 or uppermost portion of the instrument to further prevent slippage of where the instrument may be leaning against a vertical surface.

Figure 12:
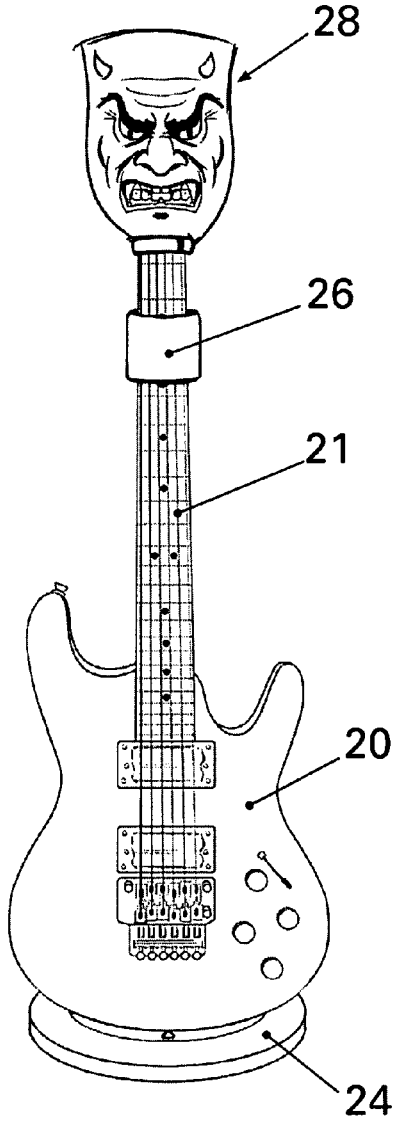
FIG. 12 is a front view of an embodiment of the present invention.

In a preferred embodiment, collar 26 and support 24 can be used together as provided in FIG. 12 to accommodate instruments of differing shape.

One or more suction cups could also be placed on collar 26. This may be beneficial when the instrument is provided against edge of desk or other horizontal surface.

Even though numerous characteristics and advantages of the present invention have been set forth in the foregoing description, together with details of the structure and function of the invention, the disclosure is illustrative only. Changes may be made in detail, especially in matters of shape, size and arrangement of parts within the principles of the invention to the full extent indicated by the broad general meaning of the terms in which the appended claims are expressed.

We claim:

1. An instrument support system for supporting on a generally horizontal surface in an upright position leaning against a vertically extending support an instrument of the type having a body part having lower and upper ends with a support strap attachment protruding from the lower end and an elongated neck part extending from the upper end, the neck part ending further from the body in a head stock, the system comprising:

a horizontal support member consisting of a support member body having a first surface on which the instrument body part lower end rests and a second surface generally parallel to the first surfer which when the instrument is supported thereon rests on the generally horizontal surface, the member having a groove extending from the first surface towards the second surface and into which the support strap attachment can protrude without contacting the generally horizontal surface;

a vertical support collar comprising a collar body of generally annular shape with an outside surface and an inside opening therein through which the instrument neck part can be passed for the collar body to be mounted on and encompass the neck part, the inside opening having an inside engagable with a corresponding part of an outside surface of the neck part, the outside surface of the collar being able to engage a corresponding part of a generally vertical surface of the vertically extending support against which the instrument rests and thereby oppose slippage of the instrument away from the upright position during such engagement; and a cap cover adapted to receive the instrument head stock therein to protect it when in contact with the vertically extending support and to inhibit slippage of the instrument away from the upright position during such contact;

wherein the cap cover is of sufficient size that when not in position on the head stock of the instrument it is large enough to contain the horizontal support member and the vertical support collar.

2. The support system of claim 1, wherein the groove in the horizontal support member is a bore extending from the first surface of the horizontal support member to the second surface thereof and the dimension of the horizontal support member from the first to the second surface is sufficient that the support strap attachment cannot contact the generally horizontal surface.

3. The support system of claim 1, wherein the instrument is an acoustic or an electric guitar, and the vertical support collar is of soft material providing the inside and outside surfaces and has an insert enabling it to grip the guitar strings and mute them.

4. The support system of claim 2, wherein the horizontal support member is horizontally of annular shape.

5. The support system of claim 1, wherein the second surface of the first horizontal support member is of a non-slip material with a co-efficient of friction between itself and the horizontal surface on which it rests sufficient to arrest any movement by the member when the instrument is resting on the first surface; and wherein the outside surface of the second annular support member is also of a non-slip material with a coefficient of friction between itself and the part of the generally vertical surface against which it is to rest to oppose any movement between itself and that part of the generally vertical surface.

6. An instrument support system for supporting on a generally horizontal surface in an upright position leaning against a vertically extending support an instrument of the type having a body part having lower and upper ends with a support strap attachment protruding from the lower end and an elongated neck part extending from the upper end, the neck part ending further from the body in a head stock, the system comprising:

a first annular horizontal support member consisting of a support member body having a first surface on which the instrument body part lower end rests, a second surface which when the instrument is in upright position rests on the generally horizontal surface, and a bore extending from the first surface through to the second surface and into which the support strap attachment can protrude without contacting the generally horizontal surface; and a second annular support comprising a vertical support collar comprising a collar body of annular shape with an outside surface and an opening therein through which the instrument neck part can be passed for the collar body to encompass the neck part and to be movable longitudinally thereon, the collar body having an inside surface at the inside of the opening for engaging a corresponding part of an outside surface of the neck part of the instrument, the outside surface of the collar being engagable with a corresponding part of a generally vertical surface of the vertically extending support against which the instrument rests and thereby opposing slippage of the instrument away from the upright position during such engagement;

the support system also comprising a cap cover adapted to receive the instrument head stock therein to protect the head stock and inhibit slippage of the instrument away from the upright position upon engagement of the cap cover with the vertically extending support, and wherein the cap cover is of sufficient size that when not in position on the head stock of the instrument it is large enough to contain the horizontal support member and the vertical support collar.

7. The support system of claim 6, wherein the instrument is an acoustic or an electric guitar, and the vertical support collar is of soft material providing the inside and outside surface and has an insert enabling it to grip the guitar strings and mute them.

8. The support system of claim 6, wherein the second surface of the first annular support member is comprised of a non-slip material with a co-efficient of friction sufficient between itself and the horizontal surface on which it rests to arrest any movement by the first support member on the horizontal surface once the instrument is placed on the support member; and wherein the second surface of the second annular support member is also comprised of a non-slip material with a coefficient of friction between itself and the part of the generally vertical surface against which it is to rest to oppose any movement between itself and that part of the generally vertical surface.

9. The support system of claim 6, wherein the horizontal support member is horizontally of annular shape.

10. An instrument support system for supporting on a generally horizontal surface an instrument in an upright position leaning against a vertically extending support an instrument of the type having a body part having lower and upper ends with a support strap attachment protruding from the lower end and an elongated neck part extending from the upper end, the neck part ending further from the body in a head stock;

the system comprising:

a first annular horizontal member consisting of a support member body having a first surface on which the instrument body part lower end rests, a second surface generally parallel to the first surface which when the instrument is in upright position rests on the generally horizontal surface, and a groove extending from the first surface towards the second surface and into which the support strap attachment can protrude, the dimension of the horizontal support member from the first to the second surface being sufficient that the support strap attachment cannot contact the generally horizontal surface, and a cap cover having an outside surface adapted to receive the instrument head stock therein to protect the head stock and inhibit slippage of the instrument away from the upright position upon engagement of the cap cover outside surface with the vertically extending support, wherein the cap cover is of sufficient size that when not in position on the head stock it can contain the horizontal support member.

11. The support system of claim 10, wherein the second surface of the horizontal support member is of a non-slip material with a co-efficient of friction between itself and the horizontal surface on which it rests sufficient to arrest any movement by the member when the instrument is resting on the first surface.

12. The support system of claim 10, wherein the outside surface of the cap member is of a non-slip material with a coefficient of friction between itself and the part of the generally vertical surface against which it is to rest to oppose any movement between itself and that part of the generally vertical surface.

13. The support system of claim 10, wherein the horizontal support member is horizontally of annular shape.

* * * * *